US006985108B2

(12) United States Patent
Mikkola et al.

(10) Patent No.: US 6,985,108 B2
(45) Date of Patent: Jan. 10, 2006

(54) INTERNAL ANTENNA

(75) Inventors: Jyrki Mikkola, Kempele (FI); Petteri Annamaa, Oulunsalo (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/663,099

(22) Filed: Sep. 15, 2003

(65) Prior Publication Data

US 2004/0058723 A1 Mar. 25, 2004

(30) Foreign Application Priority Data

Sep. 19, 2002 (FI) ..... 20021668

(51) Int. Cl.
*H01Q 1/38* (2006.01)

(52) U.S. Cl. ..... 343/700 MS; 343/702

(58) Field of Classification Search ..... 343/700 MS, 343/702, 746, 846, 848, 845
See application file for complete search history.

(56) References Cited

U.S. PATENT DOCUMENTS

| | | | | |
|---|---|---|---|---|
| 4,367,475 | A * | 1/1983 | Schiavone | 343/767 |
| 4,587,524 | A * | 5/1986 | Hall | 343/729 |
| 5,282,792 | A | 2/1994 | Imbert | 343/702 |
| 6,140,966 | A * | 10/2000 | Pankinaho | 343/700 MS |
| 6,593,888 | B2 * | 7/2003 | Fu | 343/700 MS |
| 6,791,498 | B2 * | 9/2004 | Boyle et al. | 343/702 |
| 2002/0135521 | A1 | 9/2002 | Moore | 343/702 |
| 2004/0125029 | A1 * | 7/2004 | Maoz et al. | 343/702 |

FOREIGN PATENT DOCUMENTS

| | | | |
|---|---|---|---|
| DE | 101 33 517 | A1 | 11/2002 |
| WO | 08 92 459 | A1 | 1/1999 |
| WO | WO 01/89031 | A1 * | 11/2001 |
| WO | WO 02/18671 | A1 | 3/2002 |
| WO | WO 02/89031 | A1 * | 11/2004 |

* cited by examiner

*Primary Examiner*—Trinh Vo Dinh
(74) *Attorney, Agent, or Firm*—Darby & Darby

(57) ABSTRACT

An internal planar antenna for small radio apparatuses. The ground plane (310) of the planar antenna is shaped such that it improves the matching of the antenna. The shaping may be done by means of one or more slots (315, 316) in the ground plane. The slot suitably changes the electrical length of the ground plane as viewed from the short-circuit point (S) so that the ground plane will function as a radiator in an operating band of the antenna. Also the slot (331) in the ground plane can be arranged to function as an additional radiator in an operating band of the antenna. Antenna gain will increase as the matching is improved, and the upper band of a dual band antenna, for example, can be made broader.

20 Claims, 5 Drawing Sheets

Fig. 3
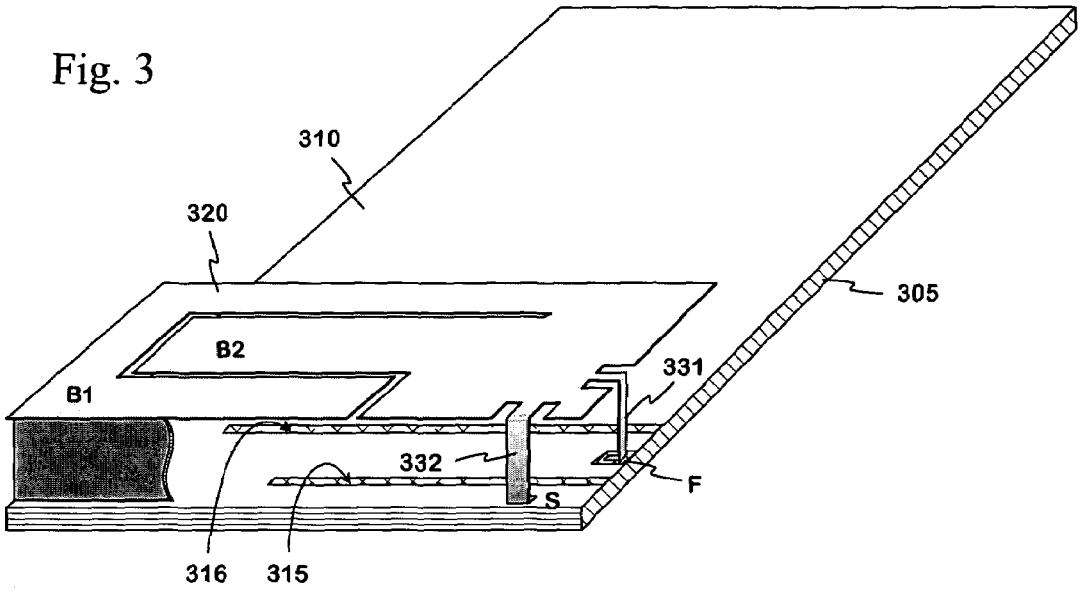
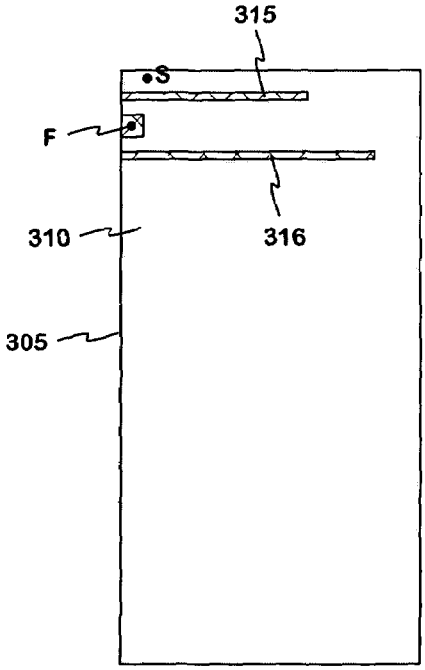
Fig. 4

INTERNAL ANTENNA

The invention relates to an internal planar antenna intended for small radio apparatuses. The invention also relates to a radio apparatus employing an antenna according to the invention.

BACKGROUND OF THE INVENTION

In antenna design, the space available is an important factor. A good-quality antenna is relatively easy to make if there are no size restrictions. In radio apparatuses, especially in mobile phones, the antenna is preferably placed within the covering of the device for convenience. As the devices get smaller and smaller, the space for the antenna keeps shrinking, too, which means tighter requirements in antenna design. Another factor contributing to this is that often an antenna has to be capable of operating in two or more frequency bands.

An antenna with satisfactory characteristics which fits inside a small device is in practice most easily implemented as a planar structure: The antenna comprises a radiating plane and a ground plane parallel thereto. In order to make impedance matching easier, the radiating plane and ground plane are usually interconnected at a suitable point by means of a short-circuit conductor, producing a PIFA (planar inverted F antenna) type structure. The size of the ground plane naturally has significance as regards the antenna characteristics. As in the case of a monopole whip, an ideal planar antenna also has a very large ground plane. As the ground plane gets smaller, the resonances of the antenna get weaker and, partly for that reason, the antenna gain decreases. If one keeps on reducing the size of the ground plane, it may at some point function as a radiator, thus changing the antenna characteristics in an uncontrolled manner.

FIG. 1 shows a known PIFA-type internal planar antenna. It includes a circuit board 105 of the radio apparatus, which board has a conductive upper surface. That conductive surface functions as a ground plane 110 for the planar antenna. At the other end of the circuit board there is a radiating plane 120 of the antenna, supported above the ground plane by a dielectric frame 150. The antenna structure further comprises, near a corner of the radiating plane, an antenna feed conductor 131 joining thereto, and a short-circuit conductor 132 connecting the radiating plane to the ground plane at a point S. From the feed conductor there is a via hole, isolated from the ground, to an antenna port on the lower surface of the circuit board 105. In the radiating plane there is a slot 125 which starts from an edge of the plane near the feed conductor 131 and ends up in the inner region of the plane near the opposite edge. The slot 125 divides the radiating plane, viewed from the short-circuit point, into two branches B1, B2 of different lengths. The PIFA thus has two separate resonance frequencies and respective operating bands.

A disadvantage of the antenna of FIG. 1, when the radio apparatus in question is very small, is that it has somewhat modest electrical characteristics. This is caused by the smallness of the ground plane, as described above, and also by the limited height of the antenna, as the radio apparatus is made relatively flat.

SUMMARY OF THE INVENTION

An object of the invention is to reduce said disadvantage associated with the prior art. An antenna according to the invention is characterized in that which is specified in the independent claim 1. A radio apparatus according to the invention is characterized in that which is specified in the independent claim 12. Some preferred embodiments of the invention are presented in the dependent claims.

The basic idea of the invention is as follows: The ground plane of a planar antenna in a small radio apparatus is shaped such that antenna's electrical performance improves. The shaping can be done by making a slot or several slots in the ground plane. The slot changes the electrical length of the ground plane, as viewed from the short-circuit point, so that the ground plane will better function as a radiator in an operating band of the antenna. The slot in the ground plane may also be arranged to serve as an additional radiator in an operating band of the antenna.

An advantage of the invention is that the antenna gain will increase as the matching improves, compared to a corresponding antenna according to the prior art. Thus it is possible, for example, to shorten the distance between the ground plane and the radiating plane proper by an amount corresponding to the antenna gain difference. This will result in an antenna having the same antenna gain but which is flatter, which is advantageous in small radio apparatuses. Another advantage of the invention is that the upper band of a dual-band antenna, for example, can be made wider. This is accomplished by suitably offsetting the resonance frequency of the slot radiator in the ground plane from the resonance frequency of the radiator proper. A further advantage of the invention is that the arrangement according to the invention is very simple.

BRIEF DESCRIPTION OF THE DRAWINGS

The invention is below described in detail. The description refers to the accompanying drawings where FIG. 3 shows an example of the planar antenna according to the invention, FIG. 4 shows the ground plane of the antenna illustrated in FIG. 3.

DETAILED DESCRIPTION OF THE INVENTION

Figure 1:
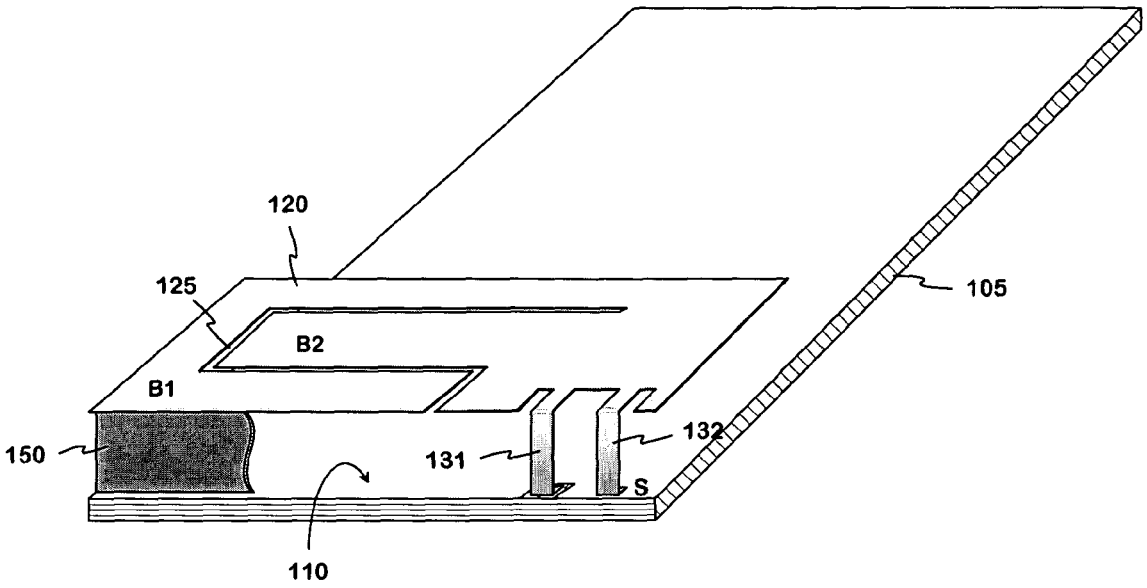
Fig. 1 PRIOR ART
FIG. 1 shows an example of a planar antenna according to the prior art.
Figure 2A:
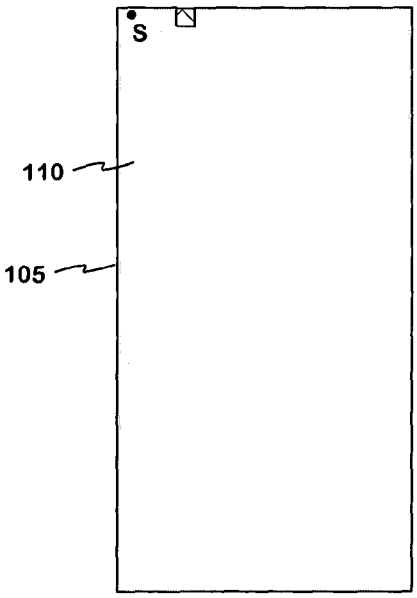
FIG. 2*a* shows an example of the ground plane of a planar antenna according to the prior art.

FIGS. 2*a,b* illustrate the principle of increasing the electrical length of the ground plane in accordance with the invention. FIG. 2*a* shows the circuit board 105 of the structure depicted in FIG. 1 as seen from the ground plane's side. At the upper left corner of the ground plane 110 there is the short-circuit point S for the radiating plane. As the ground plane has no patterns altering its shape, its electrical length, measured from the short-circuit point, is determined by the lengths of the sides of the rectangular plane. As the ground plane is relatively small, its electrical length is significant, because the ground plane may radiate at a frequency order of operating frequencies, like a branch of a dipole antenna.

Figure 2B:
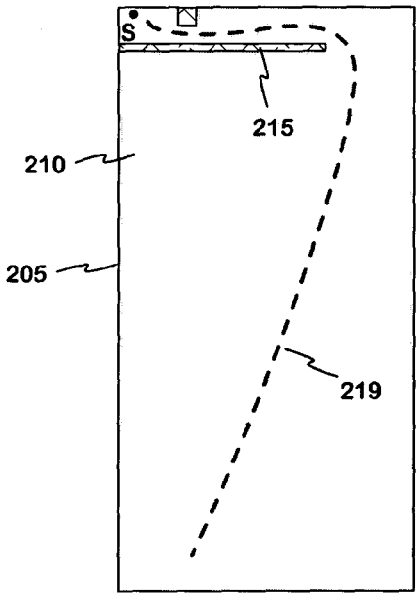
FIG. 2*b* shows an example of the ground plane of a planar antenna according to the invention.

FIG. 2*b* shows a printed circuit board 205 which is similar to the one described above except that there is now a slot 215 in the ground plane. The slot starts from the long side of the ground plane near the short-circuit point S and travels parallel to the short side of the ground plane beyond the half-way point of the short side in this example. The slot 215 increases the electrical length because now the ground plane currents have to turn around the closed end of the slot. The broken line 219 starting from the short-circuit point approximately illustrates the electrical length of the ground plane. The electrical length can be arranged e.g. such that the ground plane improves the matching of a dual-band antenna in the lower band.

FIG. 3 shows an example of a whole planar antenna according to the invention. It includes a circuit board 305 of a radio apparatus, where the conductive upper surface of the board functions as a ground plane for the planar antenna. At one end of the circuit board, above the board, there is, from the point of outline, a rectangular-shaped radiating plane 320 of the antenna, with two branches B1 and B2 of different lengths to produce two operating bands, like in FIG. 1. Near a corner of the radiating plane, a short-circuit conductor 332 extends from a long side of the radiating plane to the ground plane, which long side is parallel to a short side of the ground plane. The ground plane has a first slot 315 according to the invention, like slot 215 in FIG. 2, which first slot is located near the short-circuit point of the antenna, parallel to the short side of the ground plane. The feedline conductor 331 of the antenna joins to the radiating plane near the same corner as the short-circuit conductor, but in this example on the side of the short side of the radiating plane such that the first slot 315 goes between the short-circuit point S and feed point F marked on the circuit board. This arrangement makes possible to place the first slot 315 closer to the short side of the ground plane than what would be possible if the feed point with its via hole were on the same side, like in FIG. 1.

The example of FIG. 3 further shows a second slot 316 according to the invention. This one starts from the same long side of the ground plane and travels parallel to the first slot. In this example the feed point F lies between the first and second slots on the surface of the circuit board 305. The first 315 and second 316 slots as well as the feed point F and short-circuit point S can be better seen in FIG. 4 illustrating the circuit board 305 of the structure depicted in FIG. 3, as viewed from the ground plane side. The placement and length of the second slot 316 can be such that resonance is excited in the slot in the upper operating band of the antenna. Thus it functions as a slot radiator, improving the matching in the upper operating band. Similarly, in the single-slot case according to FIG. 2, the slot can be tuned so as to function as a radiator in the upper operating band.

Figure 5:
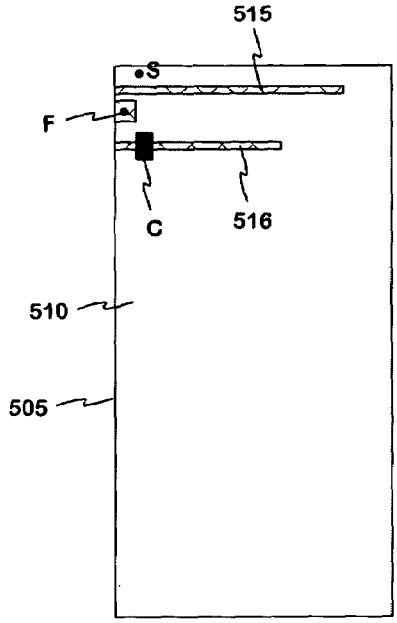
FIG. 5 shows an example of using a discrete capacitor in ground plane.

As an additional way reactive discrete components can be used in the ground plane arrangement. FIG. 5 shows an example of such an arrangement. It includes a circuit board 505 of a radio apparatus where the ground plane of the board has two slots according to the invention, like in FIG. 4. Across the second slot 516, near its open end, there is connected a capacitor C. The capacitance thereof decreases the electrical length of the ground plane, e.g. in the case of a dual-band antenna, naturally more significantly in the upper operating band than in the lower. If the slots 515, 516 in the ground plane are dimensioned so as to improve antenna characteristics in the lower operating band, the capacitor can then be used to prevent antenna characteristics from worsening in the upper operating band for the reason mentioned above. On the other hand, if the second slot is used as a radiator, the capacitor helps produce a slot with a desired electrical length, physically shorter than what it would be without a capacitor. A suitable capacitance for the capacitor in an arrangement according to FIG. 5 and in the gigahertz region is on the order of 1 pF.

Figure 6:
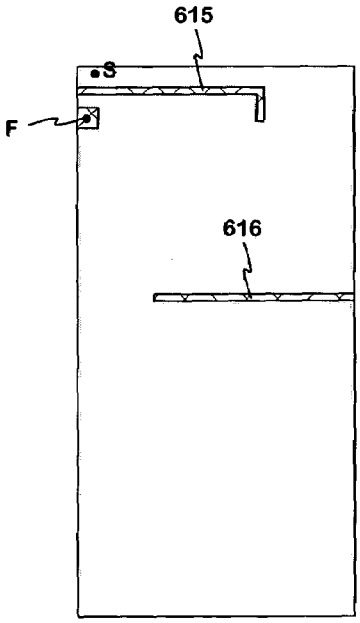
FIG. 6 shows a fourth example of the ground plane according to the invention.

FIG. 6 shows a fourth example of ground plane design according to the invention. In this case, too, the ground plane has two slots according to the invention. A first slot 615 travels between the short-circuit point S and feed point F, having a rectangular bend at the end thereof. A second slot 616 is now located lower in the ground plane, starting from a long side of the ground plane opposite to that long side at which the short-circuit and feed points are located. The first slot can be dimensioned so as to function as a radiator in the upper operating band of the antenna, and the second slot 616 can be dimensioned so as to improve antenna matching in the lower operating band by increasing the electrical length of the ground plane.

Figure 7:
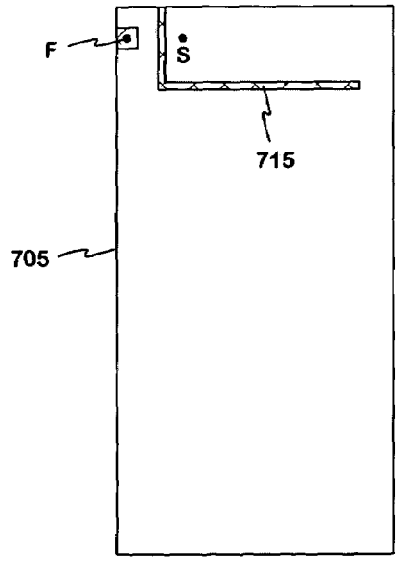
FIG. 7 shows a fifth example of the ground plane according to the invention.

FIG. 7 shows a fifth example of ground plane design according to the invention. In this case the ground plane has one slot 715 according to the invention. The feed point F is close to a corner of the circuit board 705, and the short-circuit point S is located more centrally in the direction of the short side of the board. The slot 715 starts from the edge of the ground plane at the short side of the circuit board, travels between the feed point and short-circuit point, and then turns parallel to the short side of the board, extending near the opposite long side of the circuit board. When propagating in the ground plane from the short-circuit point on, it is necessary to turn around the closed end of the slot 715, which means an increase in the electrical length of the ground plane. The difference to the structure of FIG. 2*b* is that the feed and short-circuit points are now placed on different sides of the slot in the ground plane. This can be utilized when using the slot 715 as a radiator.

Figure 8:
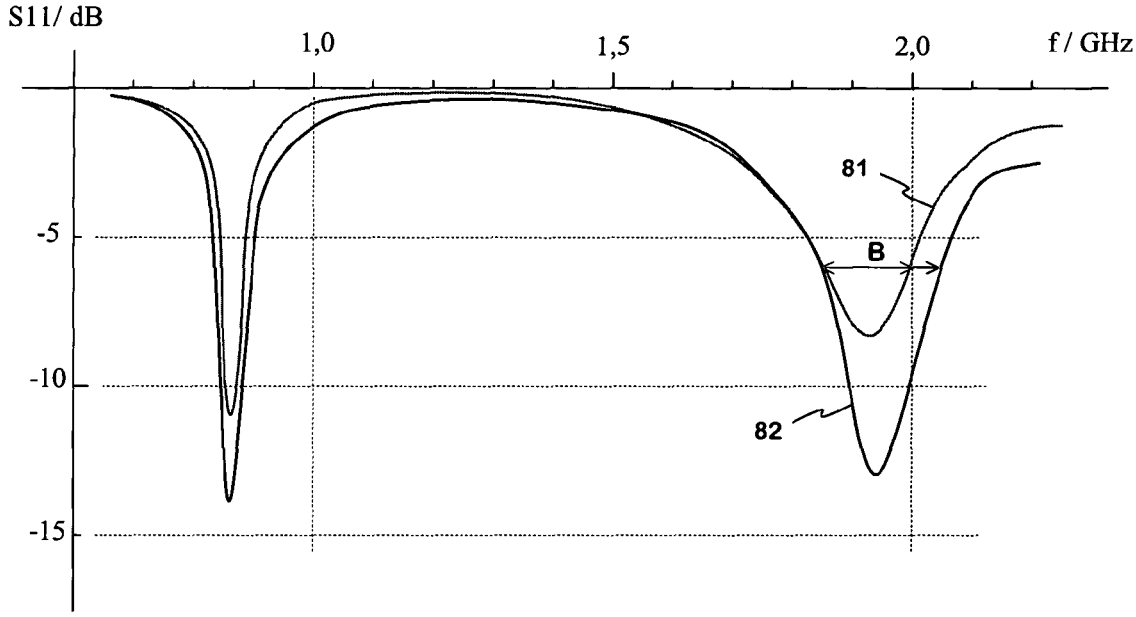
FIG. 8 shows an example of how the invention influences antenna matching.

FIG. 8 illustrates the effect of the invention on antenna matching in an example case. The quality of the matching is represented by the measured values of the reflection coefficient S11. Curve 81 illustrates the variation in the reflection coefficient of a prior-art dual-band antenna as a function of frequency, and curve 82 the variation of a corresponding antenna according to the invention which has two slots in the ground plane as depicted in FIG. 3. Comparing the curves, one can see that in the upper band, in the 1.9 GHz region, the best value of the reflection coefficient improves from −8 dB to about −13 dB, i.e. approximately by 5 dB. At the same time, the bandwidth B increases from about 150 MHz to about 200 MHz, using reflection coefficient value −6 dB as a criterion. In the lower band in the 0.9 GHz region the best value of the reflection coefficient improves by over 2.5 dB, i.e. from −11 dB to about −13.5 dB. At the same time the bandwidth increases perceptibly.

Figure 9:
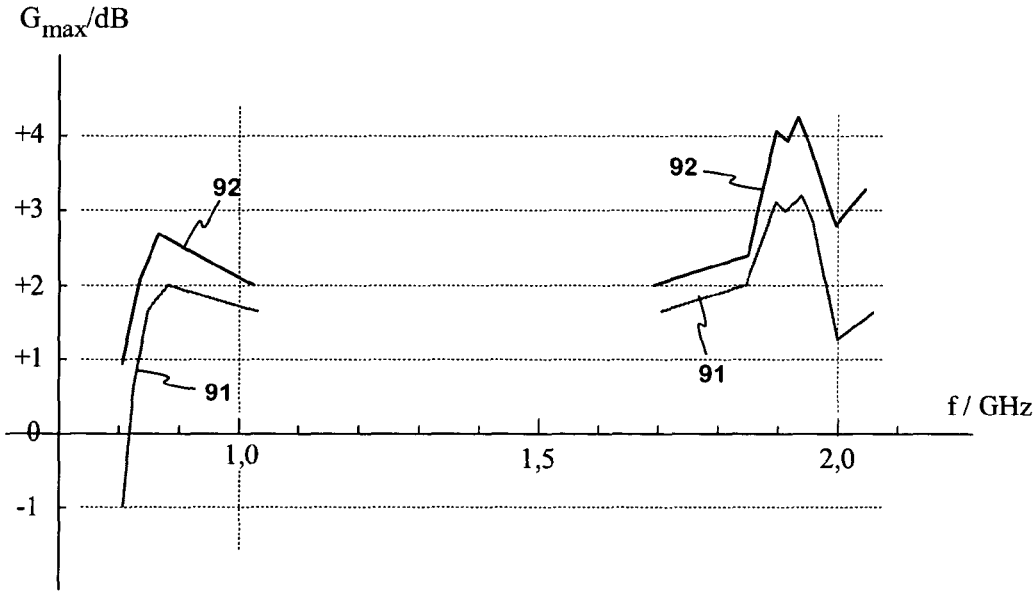
FIG. 9 shows an example of how the invention influences antenna gain.

FIG. 9 illustrates the effect of the invention on antenna gain. Antenna gain is here computed using a simulation model. Curve 91 illustrates the variation in the antenna gain $G_{max}$ of a prior art dual band antenna as a function of frequency, computed in the most advantageous direction, and curve 92 the variation in the antenna gain $G_{max}$ of a corresponding antenna according to the invention which has two slots in the ground plane as depicted in FIG. 3, computed in the most advantageous direction. Comparing the curves, one can see that in the upper band the antenna gain is improved from about 3 dB to about 4 dB, i.e. approximately by one decibel. Antenna gain is also improved in the lower operating band in the 0.9 GHz region. The increase is a little over a half decibel.

As was mentioned earlier, the improvements brought about by the invention in the electrical characteristics can be utilized by reducing the distance between the ground plane and radiating plane proper by an amount corresponding to the antenna gain difference. If the increase of about 30% in the bandwidth of the upper operating band and the one-decibel increase in antenna gain are lost in this manner, one will get a planar antenna which is about 40% flatter.

Figure 10:
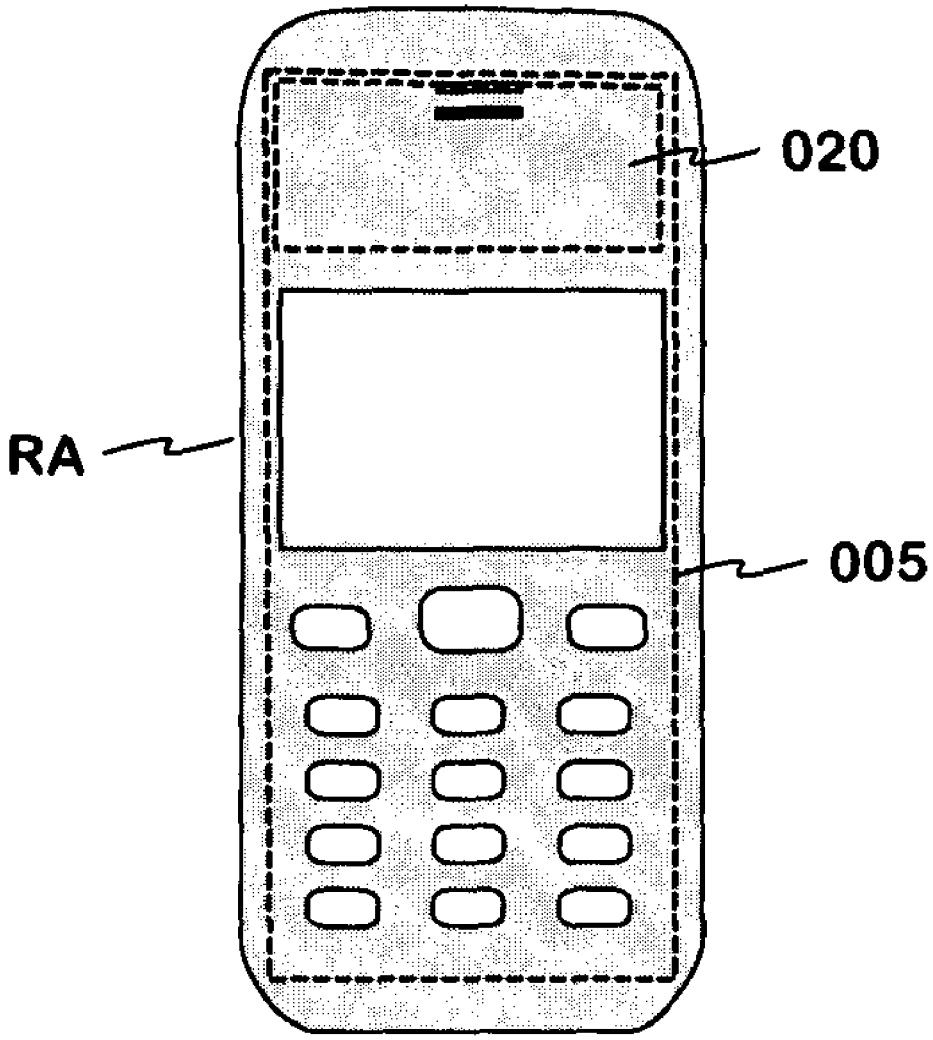
FIG. 10 shows an example of a radio apparatus equipped with an antenna according to the invention.

FIG. 10 shows a radio apparatus RA equipped with an internal planar antenna according to the invention. The antenna comprises a ground plane on the circuit board 005 of the radio apparatus, and a radiating plane 020 at that end of the circuit board which in the figure is the upper end. The ground plane has at least one slot which has an improving effect on antenna matching.

The words "lower" and "upper" and "above" refer in this description and in the claims to the positions of the antenna structure and its ground plane as depicted in FIGS. 1 to 7, and they are in no way connected to the operational position of the antenna. Likewise, mentions about the "short" and "long" sides of the structural parts refer in this description and in the claims to the dimensions depicted in FIGS. 1 to 7 and do not restrict the actual dimensions.

Some antenna structures according to the invention were described above. The invention does not limit the shapes of the antenna elements to those just described. Nor does the invention limit the fabricating method of the antenna or the materials used therein. The inventional idea can be applied in different ways within the scope defined by the independent claim 1.

What is claimed is:

1. An internal planar antenna for a radio apparatus, comprising:

a ground plane including at least first and second intersecting edges with corresponding opposite edges;

a radiating plane including a first side and a second side longer than the first side;

a feed conductor for the radiating plane;

a short-circuit conductor which connects the radiating plane to the ground plane at a short-circuit point located closer to the intersection of the intersecting edges than to the corresponding opposite edges; and the ground plane including at least one non-conductive slot to improve matching of the antenna, a starting point of the slot being located in one of the first and second intersecting edges of the ground plane closer to the short-circuit point than to the opposite edges and the slot traveling substantially parallel to the long side of the radiating plane.

2. The antenna according to claim 1 the ground plane being a conductive layer on the upper surface of a circuit board in the radio apparatus, and the radiating plane being a conductive plane above the ground plane and having an outline shaped substantially like a rectangle, wherein said short-circuit point is located relatively close, in proportion to the lengths of the sides of the radiating plane, to a projection of a corner of the radiating plane in the circuit board.

3. The antenna according to claim 2, wherein said slot in the ground plane increases the electrical length of the ground plane as measured from the short-circuit point.

4. The antenna according to claim 1 having at least a lower and an upper operating band, wherein the ground plane includes a first and a second non-conductive slot.

5. The antenna according to claim 4, wherein said feed conductor passes through the circuit board at a feed point, the second slot starting from the same edge of the ground plane as the first slot and traveling substantially parallel to the first slot, said feed point being located between the first and second slots on the circuit board.

6. The antenna according to claim 5, further comprising a capacitor connected across the second slot in the ground plane.

7. The antenna according to claim 5, the second slot in the ground plane being arranged to resonate in the upper operating band of the antenna.

8. The antenna according to claim 4, the second slot starting from an edge of the ground plane which is opposite to that edge from which the first slot starts, and the first slot being arranged to resonate in the upper operating band of the antenna.

9. The antenna according to claim 4, at least one slot in the ground plane including a portion the direction of which differs substantially from the direction of said long side of the radiating plane.

10. The antenna according to claim 1, further comprising a capacitor connected across said at least one slot in the ground plane.

11. The antenna according to claim 1 having at least a lower and an upper operating band, said slot in the ground plane being arranged to resonate in the upper operating band of the antenna.

12. A radio apparatus with an internal planar antenna comprising:

a ground plane on a circuit board, the ground plane including at least first and second intersecting edges with corresponding opposite edges;

a radiating plane including a first side and a second side longer than the first side;

a feed conductor for the radiating plane;

a short-circuit conductor which connects the radiating plane to the ground plane at a short-circuit point located closer to the intersection of the intersecting edges than to the corresponding opposite edges; and the ground plane including at least one non-conductive slot to improve matching of the antenna, a starting point of the slot being located in one of the first and second intersecting edges of the ground plane closer to the short-circuit point than to the opposite edges and the slot traveling substantially parallel to the long side of the radiating plane.

13. An internal planar antenna for a radio apparatus having at least a lower and an upper operating band, comprising:

a ground plane;

a radiating plane;

a feed conductor for the radiating plane, wherein said feed conductor passes through the circuit board at a feed point; and a short-circuit conductor which connects the radiating plane to the ground plane at a short-circuit point, the ground plane including a first and a second non-conductive slot to improve matching of the antenna, the second slot starting from the same edge of the ground plane as the first slot and traveling substantially parallel to the first slot, said feed point being located between the first and second slots on the circuit board.

14. The antenna according to claim 13, further comprising a capacitor connected across the second slot in the ground plane.

15. The antenna according to claim 13, the second slot in the ground plane being arranged to resonate in the upper operating band of the antenna.

16. The antenna according to claim 13, the ground plane being a conductive layer on the upper surface of a circuit board in the radio apparatus, and the radiating plane being a conductive plane above the ground plane and having an outline shaped substantially like a rectangle, wherein said short-circuit point is located relatively close, in proportion to the lengths of the sides of the radiating plane, to a projection of a corner of the radiating plane in the circuit board.

17. The antenna according to claim 16, wherein said slot in the ground plane increases the electrical length of the ground plane as measured from the short-circuit point.

18. The antenna according to claim 13 having at least a lower and an upper operating band, wherein the ground plane includes a first and a second non-conductive slot.

19. The antenna according to claim 18, the second slot starting from an edge of the ground plane which is opposite to that edge from which the first slot starts, and the first slot being arranged to resonate in the upper operating band of the antenna.

20. The antenna according to claim 13 having at least a lower and an upper operating band, said slot in the ground plane being arranged to resonate in the upper operating band of the antenna.

* * * * *